US010711796B2

(12) United States Patent
Michelassi et al.

(10) Patent No.: US 10,711,796 B2
(45) Date of Patent: Jul. 14, 2020

(54) MULTISTAGE CENTRIFUGAL COMPRESSOR

(71) Applicant: Nuovo Pignone Srl, Florence (IT)

(72) Inventors: Vittorio Michelassi, Garching b Munich (DE); Ismail Hakki Sezal, Garching b Munich (DE); Christian Aalburg, Garching b Munich (DE)

(73) Assignee: NUOVO PIGNONE SRL, Florence (IT)

( * ) Notice: Subject to any disclaimer, the term of this patent is extended or adjusted under 35 U.S.C. 154(b) by 225 days.

(21) Appl. No.: 14/916,600

(22) PCT Filed: Sep. 2, 2014

(86) PCT No.: PCT/EP2014/068620
§ 371 (c)(1),
(2) Date: Mar. 4, 2016

(87) PCT Pub. No.: WO2015/032756
PCT Pub. Date: Mar. 12, 2015

(65) Prior Publication Data

US 2016/0222981 A1 Aug. 4, 2016

(30) Foreign Application Priority Data

Sep. 5, 2013 (IT) ..... FI2013A0208

(51) Int. Cl.
*F04D 17/12* (2006.01)
*F04D 29/46* (2006.01)
(Continued)

(52) U.S. Cl.
CPC ..... *F04D 29/462* (2013.01); *F04D 17/12* (2013.01); *F04D 17/122* (2013.01);
(Continued)

(58) Field of Classification Search
CPC ... F04D 1/04; F04D 1/06; F04D 17/12; F04D 17/122; F04D 29/04; F04D 29/056;
(Continued)

(56) References Cited

U.S. PATENT DOCUMENTS 3,941,499 A * 3/1976 Kronogard ..... F01D 25/002 415/116
3,986,791 A 10/1976 Paciga et al.
(Continued)

FOREIGN PATENT DOCUMENTS

CN 2769572 Y 4/2006
CN 201896763 U 7/2011
(Continued)

OTHER PUBLICATIONS

Machine translation of Miyaji, Japanese Patent Document H11-62877. Retrieved from Espacenet on Nov. 8, 2018.*
(Continued)

*Primary Examiner* — Carlos A Rivera
*Assistant Examiner* — Sang K Kim
(74) *Attorney, Agent, or Firm* — Baker Hughes Patent Organization

(57) ABSTRACT

A multistage centrifugal compressor is described. The compressor comprises a casing and a shaft rotatingly supported in the casing by at least a first bearing and a second bearing. At least one in-between-bearing impeller is mounted on the shaft, between the first bearing and the second bearing. An overhung impeller is mounted at one end of the shaft. A first diaphragm arrangement is further located in the casing. The first diaphragm arrangement comprises return a channel assembly with a plurality of stationary return channel blades defining a plurality of return vanes for redirecting compressed gas from an exit location of the overhung impeller to an inlet location of the in-between-bearings impeller. The
(Continued)

first diaphragm arrangement houses one of the first bearing and second bearing.

12 Claims, 5 Drawing Sheets

(51) Int. Cl.

| | |
|---|---|
| ***F04D 29/056*** | (2006.01) |
| ***F04D 29/058*** | (2006.01) |
| ***F04D 29/059*** | (2006.01) |
| ***F04D 29/26*** | (2006.01) |
| ***F04D 29/28*** | (2006.01) |
| ***F04D 29/42*** | (2006.01) |
| ***F04D 29/44*** | (2006.01) |

(52) U.S. Cl.
CPC ..... *F04D 29/056* (2013.01); *F04D 29/058* (2013.01); *F04D 29/059* (2013.01); *F04D 29/266* (2013.01); *F04D 29/284* (2013.01); *F04D 29/4206* (2013.01); *F04D 29/444* (2013.01)

(58) Field of Classification Search
CPC ..... F04D 29/058; F04D 29/059; F04D 29/06; F04D 29/063; F04D 29/20; F04D 29/266; F04D 29/284; F04D 29/4206; F04D 29/444; F04D 29/462
See application file for complete search history.

(56) References Cited

U.S. PATENT DOCUMENTS

| | | | | |
|---|---|---|---|---|
| 4,105,372 | A * | 8/1978 | Mishina | F01D 15/12 415/122.1 |
| 4,579,509 | A | 4/1986 | Jacobi | |
| 4,645,419 | A | 2/1987 | Furuya et al. | |
| 5,449,235 | A * | 9/1995 | Buckmann | F16C 32/0651 384/108 |
| 6,595,746 | B1 | 7/2003 | Goto et al. | |
| 2010/0272564 | A1 | 10/2010 | Richter et al. | |
| 2015/0104335 | A1* | 4/2015 | Faller | F04D 29/5806 417/244 |

FOREIGN PATENT DOCUMENTS

| | | | |
|---|---|---|---|
| EP | 0301285 | A1 | 2/1989 |
| FR | 2958346 | A1 | 10/2011 |
| JP | 59131599 | U | 9/1984 |
| JP | 10331793 | A | 12/1998 |
| JP | 1162877 | A | 3/1999 |
| JP | 2002106487 | A | 4/2002 |
| JP | 2004150404 | A | 5/2004 |
| JP | 2012102712 | A | 5/2012 |

OTHER PUBLICATIONS

Ismail Sezal et al., filed May 6, 2015, U.S. Appl. No. 14/441,082.
Pfleiderer, "The Guiding Devices", The Centrifugal Pumps for Liquids and Gases, vol. No. 14, pp. 352-387, 1961.
Veress et al., "Inverse Design and Optimization of a Return Channel for Multistage Centrifugal Compressor" Journal of Fluids Engineering, vol. No. 126, pp. 799-806, Sep. 2004.
Unofficial English Translation of Italian Search Report issued in connection with Related IT Application No. CO2012A000055 on Jul. 23, 2013.
PCT Search Report and Written Opinion issued in connection with Related PCT Application No. PCT/EP2013/073049 dated Dec. 5, 2013.
Unofficial English Translation of Italian Search Report issued in connection with corresponding IT Application No. FI2013A000208 dated May 27, 2014.
PCT Search Report and Written Opinion issued in connection with corresponding PCT Application No. PCT/EP2014/068620 dated Nov. 3, 2014.
U.S. Non-Final Office Action issued in connection with Related U.S. Appl. No. 14/441,082 dated Mar. 7, 2017.
Unofficial English Translation of Chinese Office Action issued in connection with corresponding CN Application No. 201480049025.9 dated Mar. 31, 2017.
Machine translation and Japanese Office Action issued in connection with corresponding JP Application No. 2016539506 dated Jul. 3, 2018.

* cited by examiner

STATE OF THE ART

MULTISTAGE CENTRIFUGAL COMPRESSOR

TECHNICAL FIELD

Embodiments of the subject matter disclosed herein generally relate to multistage centrifugal compressors. More specifically, embodiments disclosed herein relate to centrifugal compressors provided with movable inlet guide vanes.

BACKGROUND ART

Centrifugal compressors are utilized extensively in many industries today across a wide variety of applications. A consistent request from users of centrifugal compressors to the manufactures of centrifugal compressors is to produce a machine with a smaller size and lower cost having the same performance characteristics of the existing generation of centrifugal compressors. This request involves the necessity of improving the efficiency of the compressor such that reducing the size of the centrifugal compressor results in a lower cost machine without reducing the performance of the machine.

Centrifugal compressors generally have multiple stages, each comprising a rotating impeller, and return channels which include fixed return channel blades forming fixed vanes for redirecting the compressed gas from the exit location of the impeller of one stage to the entry location of the impeller of the next stage along the gas flow path through the machine and for removing the tangential component of the flow.

In some known centrifugal compressors movable inlet guide vanes, also named variable inlet guide vanes, are provided for modifying the flow conditions of the incoming gaseous flow depending upon the operating conditions of the machine.

FIG. 1 illustrates a multistage centrifugal compressor of the current art, globally labeled 100. The compressor 100 has an outer casing 101 provided with an inlet manifold 102 and an outlet manifold 103. Inside the casing 101 several components, globally named "compressor bundle", are arranged, which define a plurality of compressor stages. More specifically, inside the casing 1 a rotary shaft 105 is arranged. The shaft 105 is supported by two end bearings 106, 107. Each bearing can in actual fact be a bearing assembly comprised of one or more bearing components. Between the two bearings 106, 107 a plurality of impellers 109 are mounted on the shaft 105. The inlet 109A of the first impeller 109 is in fluid communication with an inlet plenum 111, wherein gas to be compressed is delivered through the inlet manifold 102. The gas flow enters the inlet plenum 111 radially and is then delivered through a set of movable inlet guide vanes 113 and enters the first impeller 109 in a substantially axial direction.

The outlet 109B of the last impeller 109 is in fluid communication with a volute 115, which collects the compressed gas and delivers it towards the outlet manifold 103.

Stationary diaphragms 117 are arranged between each pair of sequentially arranged impellers 109. Diaphragms 117 can be formed as separate, axially stacked components. In other embodiments, the diaphragms 117 can be formed in two substantially symmetrical halves. Each diaphragm 117 defines return channels 119 which extend from the radial outlet of the respective upstream impeller 109 to the inlet of the respective downstream impeller 109, returning the compressed gaseous flow from the upstream impeller towards the downstream impeller. Fixed blades 121 are provided in the return channels 119, for removing the tangential component of the flow while redirecting the compressed gas from the upstream to the downstream impeller.

SUMMARY OF THE INVENTION

A multistage compressor is provided, comprising a rotary shaft housed in a casing and supported by end bearings. One or more impellers are supported in-between-bearings, i.e. on the shaft between the end bearings which rotatingly support the shaft in the compressor casing. An additional impeller is mounted in an overhung position, i.e. cantileverly supported at one end of the shaft. Specifically, the overhung impeller is the most upstream impeller, i.e. the one arranged at the shaft end facing the inlet plenum of the compressor. Return channels are provided between the overhung impeller and the subsequent in-between-bearings impeller. The overhung impeller is thus arranged in an inlet plenum which can be free of mechanical components along the rotation axis; the inlet plenum is integrated in the casing. The gas flow from the compressor inlet to the axial inlet of the first, overhung impeller is thus easier. Inlet guide vanes can be placed in an easy-to-reach location outside the inlet plenum, e.g. at the inlet manifold. The first shaft bearing is connected to the stationary structure of the compressor via a first diaphragm and the relevant stationary return channel blades.

According to some embodiments, a multistage centrifugal compressor is thus provided, comprising a casing and a shaft rotatingly supported in the casing by least a first bearing and a second bearing. The compressor further comprises an overhung impeller and at least one in-between-bearings impeller mounted between the first bearing and the second bearing. The overhung impeller and the in-between-bearings impeller are mounted on the shaft for rotation therewith. A first diaphragm arrangement is located in the casing, and comprises a return channel assembly with a plurality of fixed return channel blades defining a plurality of return vanes for redirecting a compressed gas from an exit location of the overhung impeller to an inlet location of the adjacent in-between-bearings impeller. According to some embodiments, the fixed return channel blades extend to a region proximate a bend apex of said plurality of return channels. This arrangement provides for additional mechanical stiffness. The diaphragm arrangement houses one of the first bearing and second bearing. A direct flow connection from the overhung impeller towards the in-between-bearings impeller(s) is thus entirely formed within the compressor casing.

According to some embodiments, a plurality of in-between-bearings impellers can be supported on the rotary shaft.

According to some embodiments, the compressor can be provided with an arrangement of variable inlet guide vanes. In some embodiments, the variable inlet guide vanes are located outside the compressor casing. For instance, the variable inlet guide vanes, also named movable inlet guide vanes, can be located radially at the inlet manifold, upstream of an inlet plenum where the axial inlet of the overhung impeller is positioned.

According to some embodiments, the inlet manifold can be arranged radially, with respect to the rotation axis of the compressor shaft. In other embodiments the inlet manifold can be arranged substantially co-axial to the overhung impeller for generating an axial gas inlet flow.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
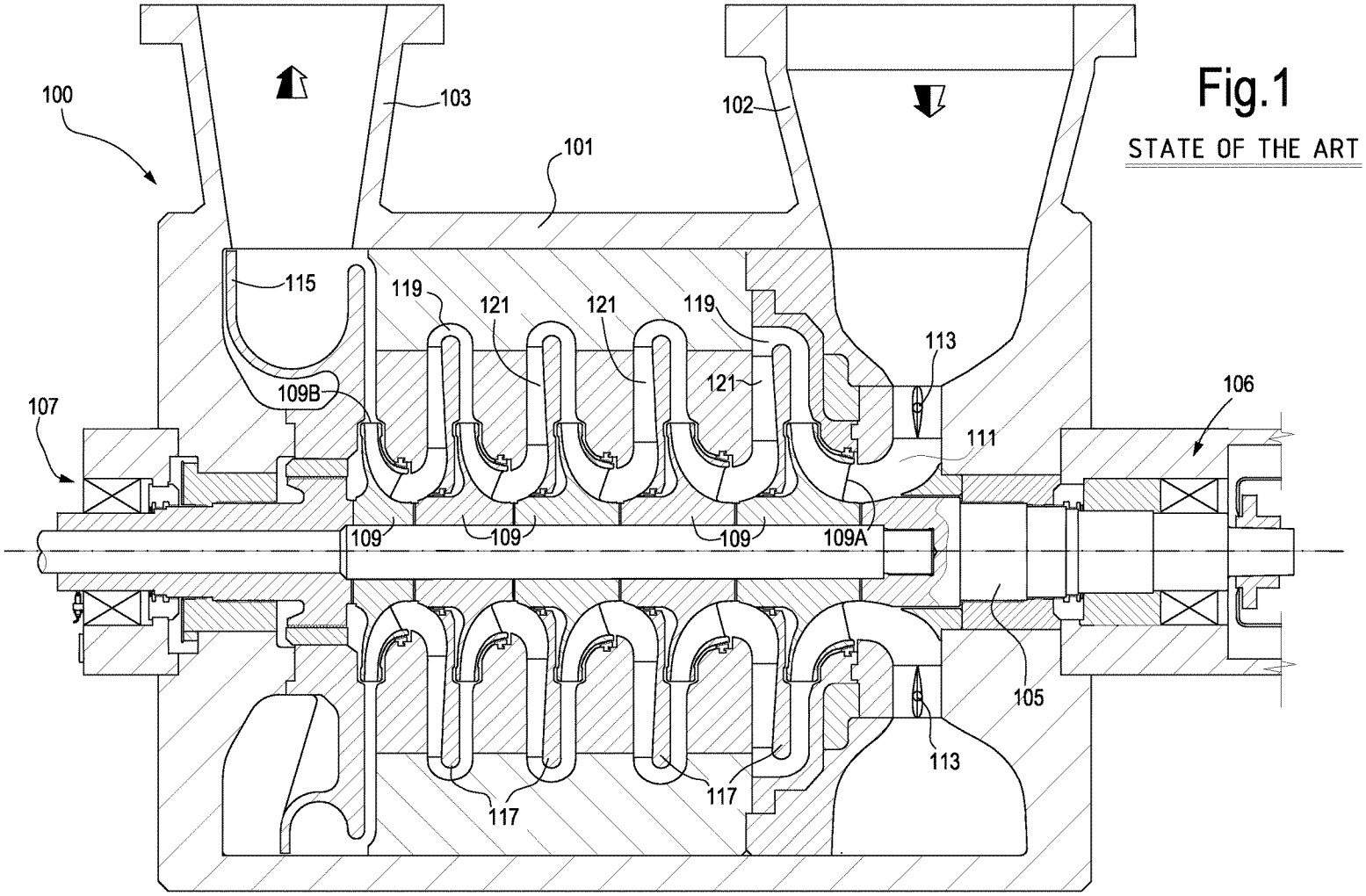
FIG. 1 illustrates a sectional view of a multistage centrifugal compressor of the current art.
Figure 2:
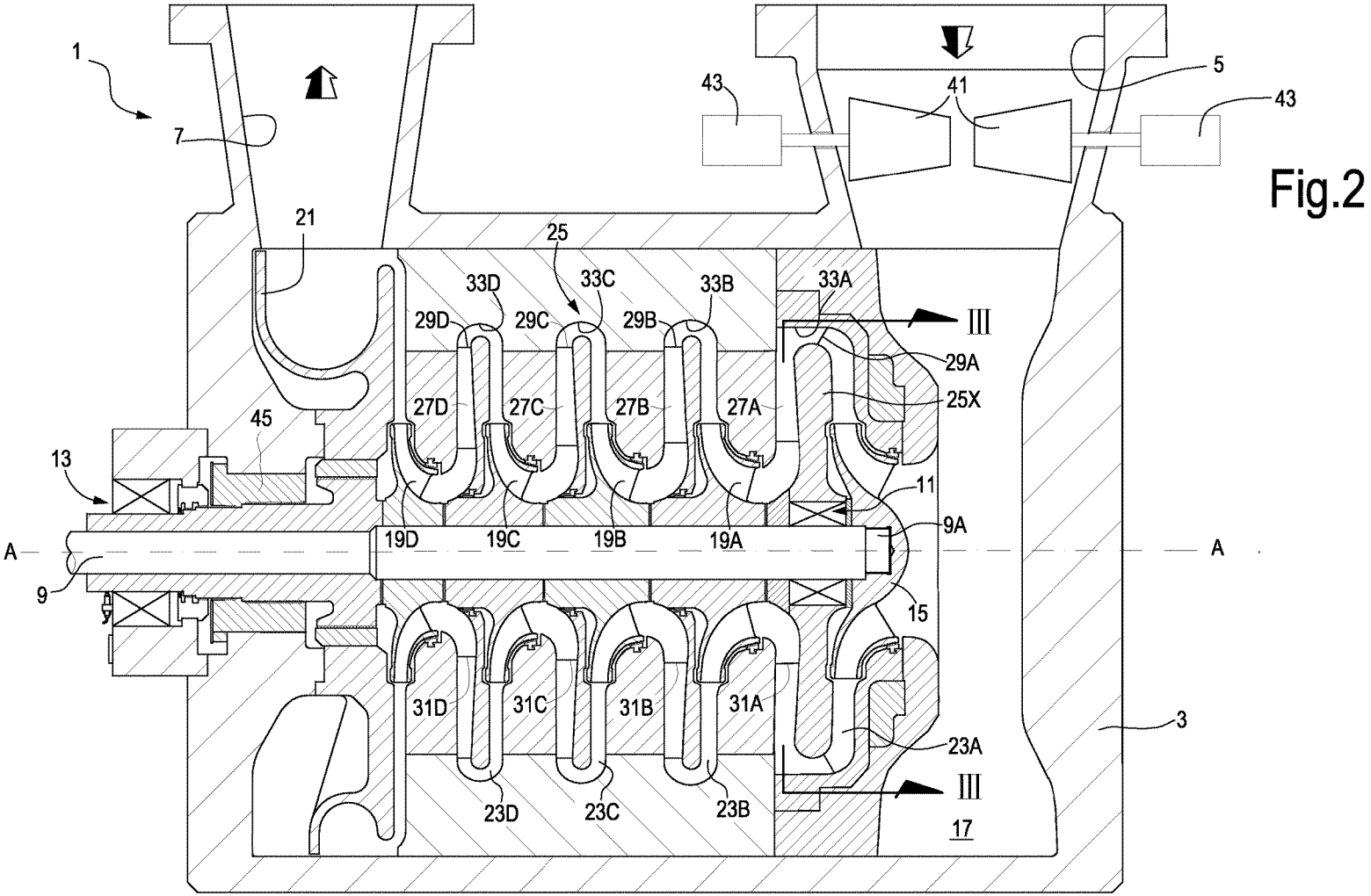
FIG. 2 illustrates a sectional view of a multistage centrifugal compressor of the present disclosure in a first embodiment.

FIG. 2 illustrates a multistage centrifugal compressor according to the subject matter disclosed herein in a section along a vertical plane containing the axis A-A of the centrifugal compressor. The compressor is globally labeled 1 and comprises an outer casing 3 with an inlet manifold 5 and an outlet manifold 7. The compressor 1 can be of the vertically split or horizontally split type.

A rotary shaft 9 is arranged within the casing 3. According to some embodiments, the rotary shaft 9 is supported by two bearings 11 and 13. Each bearing 11 and 13 can be comprised of one or more bearing components, for example axial bearing and/or radial bearing components, depending upon the design of the compressor 1. The bearings 11 and 13 can be lube oil bearings or magnetic bearings according to the design choice.

The casing 3 houses components forming the compressor bundle and more specifically a plurality of impellers, a plurality of diaphragms defining respective return channels, and a volute which collects the compressed gas and delivers said compressed gas through the outlet manifold 7.

More specifically, the casing 3 houses a first impeller 15, which is mounted on a first end 9A of the rotary shaft 9. The first impeller 15 is an overhung impeller, i.e. it is cantileverly supported by the end of shaft 9, which extends beyond the bearing 11. The overhung impeller thus projects within an inlet plenum 17, which is in fluid communication with the inlet manifold 5.

Along the shaft 9 one or more further impellers are arranged for co-rotation with the shaft 9, downstream from the first impeller 15. In the embodiment shown in FIG. 2 four additional impellers 19A, 19B, 19C and 19D are sequentially arranged from the low pressure side to the high pressure side of the compressor 1. The outlet of the last impeller 19D is in fluid communication with the volute 21. Compressed gas is collected by the volute 21 and conveyed to the outlet manifold 7.

The impellers 19A-19D are so called in-between-bearings impellers, as they are mounted on the rotary shaft 9 between the two bearings 11 and 13, contrary to the overhung impeller 15, which is arranged on the shaft end.

A return channel arrangement is provided between each pair of sequentially arranged impellers. More specifically, a first set of return channels 23A are arranged between the radial outlet of the overhung impeller 15 and the axial inlet of the first in-between-bearings impeller 19A. The return channel arrangement 23A collects the gas discharged from the overhung impeller 15 and returns the gas flow towards the axis A-A of the centrifugal compressor 1 at the inlet of the first in-between-bearings impeller 19A. Similarly, return channel arrangements 23B, 23C and 23D are located between each impeller 19A-19C and the respective downstream impeller, the last return channel arrangement 23D being located between the exit of the impeller 19C and the inlet of the last in-between-bearings impeller 19D.

The return channel arrangements 23A, 23B, 23C and 23D are formed by so-called diaphragms globally labeled 25 arranged within the casing 3 and forming part of the compressor bundle.

According to some embodiments, each return channel arrangement 23A-23D comprises a plurality of stationary return channel blades labeled 27A-27D respectively. Each return channel blade comprises a leading edge and a trailing edge. The blades of the first return channel 23A are comprised of respective leading edges 29A and trailing edges 31A. Similarly the leading edges and the trailing edges of the return channel blades 27B-27D are labeled 29B-29D and 31B-31D, respectively.

Each return channel arrangement comprises a bend apex, shown at 33A-33D for impeller 15 and impellers 19A-19C, respectively. The stationary return channel blades 27A arranged between the overhung impeller 15 and the first in-between-bearings impeller 19A develop radially at least up to the area of the bend apex 33A. In some embodiments the stationary return channel blades 27A can develop around the bend apex 33A, so that the leading edges 29A of said return channel blades 27A are located upstream (with respect to the gas flow direction) from the bend apex 33A and the trailing edge 31A is arranged downstream from said bend apex 33A. The remaining stationary return channel blades 27B-27D can have a shorter extension with leading edges 29B-29D arranged downstream from the bend apex 33B-33D.

The return channel blades 27A form a mechanical connection between an inner part or core 25X of the relevant diaphragm or diaphragm arrangement of the overhung impeller, and the outer part of said diaphragm arrangement, and thus with the outer casing 3.

The inner part 25X of the diaphragm 25 of the overhung impeller 15 forms a housing for the first bearing 11. The latter is therefore connected mechanically to the outer part of the compressor bundle and to the casing 3 through the stationary return channel blades 27A, which form the return channels between the overhung impeller 15 and the first in-between-bearings impeller 29A.

Figure 3:
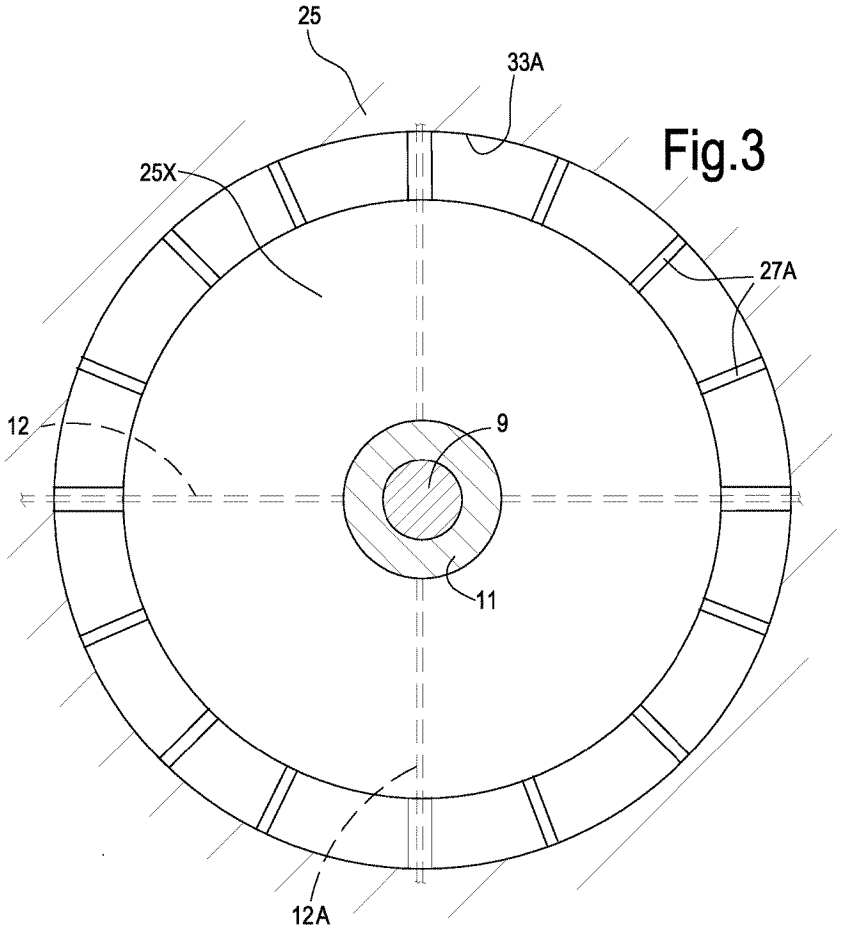
FIG. 3 illustrates a cross-sectional view according to line of FIG. 2.
Figure 2A:
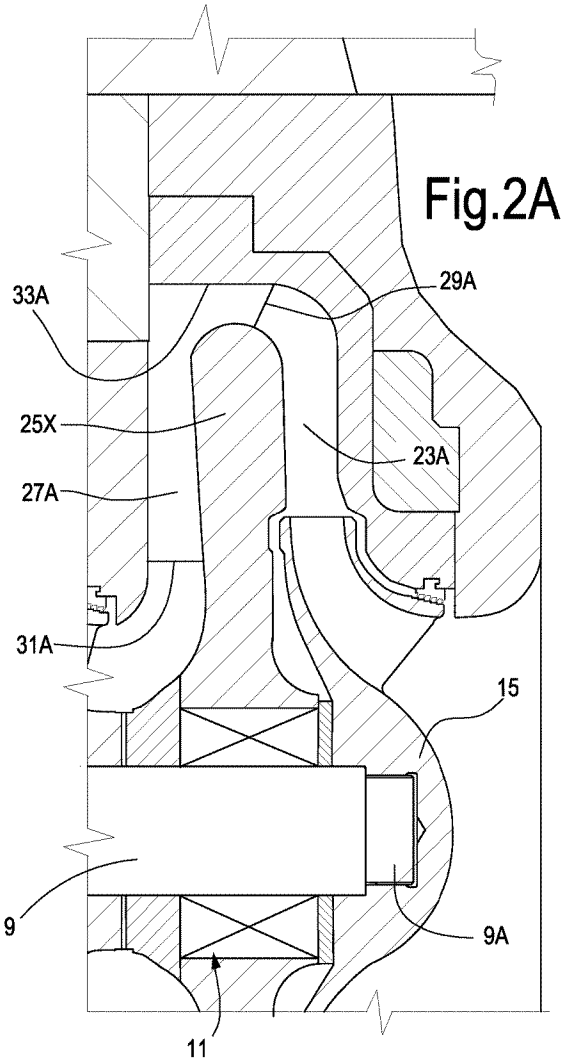
FIG. 2A illustrates a sectional view of FIG. 2 showing a return channel arrangement of the present disclosure according to an embodiment.

FIG. 3 illustrates a schematic cross-section according to line of FIG. 2. The cross-sectional view of FIG. 3 illustrates the rotary shaft 9, the first bearing 11, the core or inner part 25X of the diaphragm of the overhung impeller 15 and the stationary return channel blades 27A, which establish a mechanical connection between the diaphragm core 25X and the outer part of the compressor bundle. Thus, the mechanical connection provided by the stationary return channel blades 27A establishes a connection between the bearing 11 and the outer casing 3 of the compressor 1.

According to some embodiments, the bearing 11 may require oil lubrication. In some embodiments, one or more lubrication oil ducts 12 can be provided for that purpose through the core 25X of the first diaphragm 25 and through one or more stationary return channel blades 27A. According to other embodiments, some of said stationary return channel blades 27A can be provided with a thicker leading edge 29A, as schematically shown in FIG. 3, so that the lubrication oil ducts 12 can be easily machined through said blades.

According to other embodiments, the bearing 11 can be a magnetic bearing requiring electric powering. In some embodiments, electric wiring 12A can be provided through the core 25X of the diaphragm, and through at least one of the stationary return channel blades 27A, the wiring 12A extending substantially along a path corresponding to the lubrication oil ducts 12 disclosed in FIG. 3. The return channel blades 27A through which the wiring 12A extends can have a thicker leading edge.

The above described arrangement results in a multistage centrifugal compressor having an overhung impeller 15 and one or more in-between-bearings impellers 19A-19D housed in the same casing 3. The gas flow path extends therefore from the inlet manifold 5 to the outlet manifold 7 entirely within the casing 3 and through the impellers and return channels arrangement as described above from the inlet plenum 17 to the volute 21.

By arranging the first impeller 15 in an overhung arrangement, the inlet plenum 17 is entirely free of mechanical members, in particular of the rotary shaft 9. This allows arranging variable or movable inlet guide vanes 41 in an area distant of the compressor axis A-A. In some embodiments, the variable inlet guide vanes 41 can be located in the inlet manifold 5 and control means 43 for controlling the movement of said variable inlet guide vanes can be arranged entirely outside the casing 3. This renders the variable inlet guide vanes 41 and relevant instrumentalities and actuators for their movement and control easily accessible for maintenance or repairing purposes.

Arranging the variable inlet guide vanes 41 outside the casing 3 and outside the inlet plenum 17 is made possible by having removed the rotary shaft 9 from the inlet plenum 17 so that any swirl generated by the variable inlet guide vanes in the radial inlet can reach the overhung impeller 15 easily without being excessively distorted by the presence of mechanical members obstructing the inlet plenum 17.

According to some embodiments, the first bearing 11 on the low pressure side of the compressor 1 is entirely "in the gas", and does not require a dry gas seal. Such a dry gas seal is only required on the opposite, high pressure side of the shaft 9, where the second bearing 13 is arranged. Reducing the number of dry gas seals contributes to increasing the reliability of the compressor and reduces the overall costs thereof.

Figure 4:
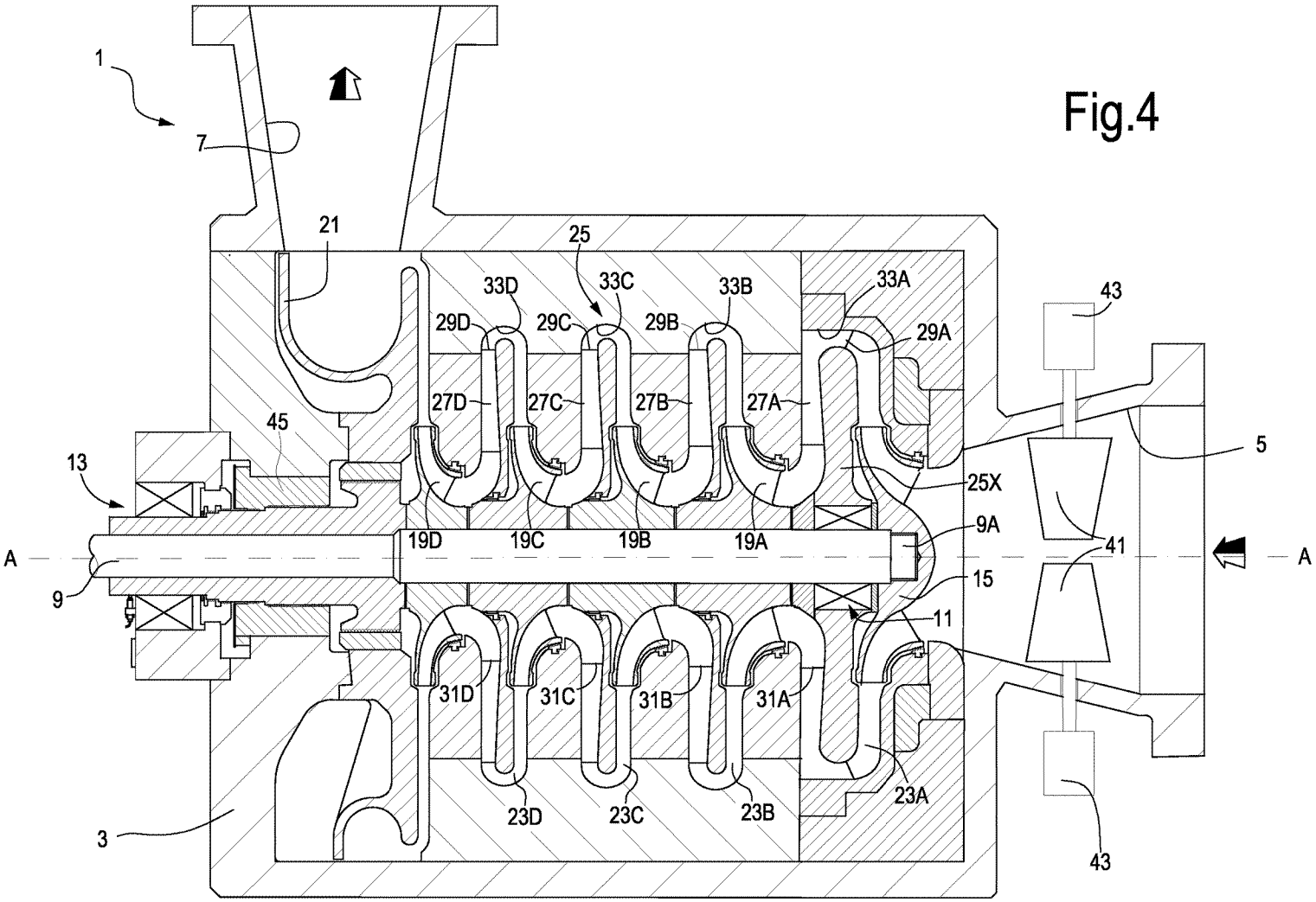
FIG. 4 illustrates a sectional view of a multistage centrifugal compressor of the present disclosure according to a further embodiment.

FIG. 4 schematically illustrates a further embodiment of a multistage centrifugal compressor according to the present disclosure. The same reference numbers are used to indicate the same or corresponding components, elements or features as disclosed in connection with FIGS. 2 and 3.

The main difference between the embodiments of FIGS. 2 and 4 concerns the arrangement of the inlet manifold. In the embodiment of FIG. 4 the gas inlet is through and axial inlet manifold, again labeled 5. The arrangement of the compressor bundle and specifically the arrangement of the overhung impeller 15, the in-between bearings impellers 19A-19D and the return channels and relevant diaphragms can be largely the same or similar to what has been disclosed here above with reference to FIGS. 2 and 3.

The layout of the compressor 1 in FIG. 4 is particularly beneficial as far as the arrangement of the movable or variable inlet guide vanes 41 is concerned. The variable inlet guide vanes 41 and the actuating members 43 thereof can be again arranged at the inlet manifold outside the main casing 3 of the compressor 1, making the variable inlet guide vanes arrangement easily accessible from the outside, without requiring dismantling the casing 3. The variable inlet guide vanes 41 can be arranged just in front of an axial inlet plenum, positioned axially in front of the overhung impeller 15, quite in the same manner as in an integrally geared compressor, resulting in high efficiency of the compressor.

Figure 5:
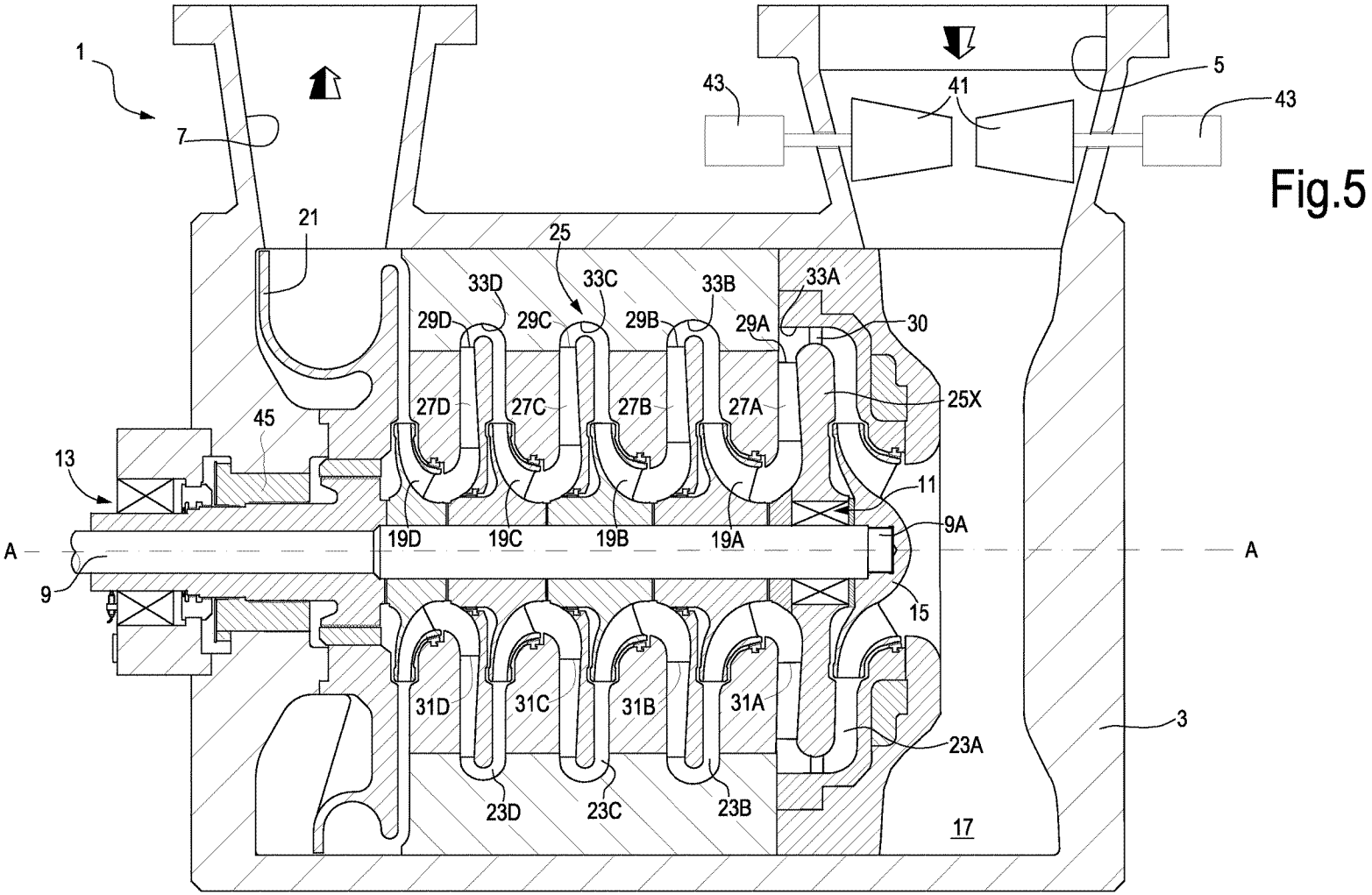
FIG. 5 illustrates a sectional view similar to FIG. 2 in a modified embodiment.

FIG. 5 illustrates a sectional view of a modified embodiment, similar to the embodiment of FIG. 2. The same reference numbers are used to indicate the same or corresponding parts as in FIG. 2. In the embodiment of FIG. 5 the stationary return channel blades 27A of the first compressor stage are shorter and the leading edges 29A thereof are located on the side of the stationary inner part 25X of the diaphragm facing the pressure end of the compressor. Mechanical connection between the inner part 25X of the diaphragm 25 and the compressor casing is still provided by the stationary return channel blades. Additionally, spacers 30 can be arranged in the return channels between the outlet of the impeller and the apex 33A of the return channels. The spacers 30 can provide additional mechanical stiffness.

Lubrication oil ducts or wiring for the bearing 11 can extend through the stationary return channel blades 27A and/or through the spacers 30.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

What is claimed is:

1. A multistage centrifugal compressor comprising:

a casing;

a shaft rotatingly supported in the casing by at least a first bearing and a second bearing;

at least one in-between-bearing impeller mounted on the shaft between the first bearing and the second bearing;

an overhung impeller mounted at one end of the shaft;

a first diaphragm arrangement located in the casing, comprising a return channel assembly with a plurality of stationary return channel blades, defining a plurality of return vanes for redirecting compressed gas from an exit location of the overhung impeller to an inlet location of the in-between-bearings impeller; and an inlet plenum in the casing;

wherein the first diaphragm arrangement houses one of the first bearing and second bearing, and wherein at least one lubrication oil duct for the bearing housed in the first diaphragm arrangement is provided through the first diaphragm arrangement, the at least one lubrication oil duct extending through at least one of the respective stationary return channel blades.

2. The compressor of claim 1, wherein the stationary return channel blades extend to a region proximate a bend apex of the plurality of return channels.

3. The compressor of claim 1, wherein the overhung impeller, the first diaphragm arrangement and the at least one in-between-bearings impeller are arranged in the casing.

4. The compressor of claim 1, further comprising at least a second in-between-bearings impeller, arranged between the first bearing and the second bearing.

5. The compressor of claim 1, further comprising an arrangement of variable inlet guide vanes.

6. The compressor of claim 5, wherein the variable inlet guide vanes are arranged radially around the inlet plenum, in fluid communication with the overhung impeller.

7. The compressor of claim 5, wherein the variable inlet guide vanes are arranged axially in front of the overhung impeller for generating an axial gas inlet flow.

8. The compressor of claim 1, wherein the overhung impeller is supported at one end of the shaft and faces the inlet plenum.

9. The compressor of claim 1, wherein at least one electric wiring for the bearing housed in the first diaphragm arrangement is provided through the first diaphragm arrangement.

10. The compressor of claim 9, wherein the at least one electric wiring extends through at least one of the respective stationary return channel blades.

11. The compressor of claim 1, wherein the inlet plenum is an axial inlet plenum.

12. The compressor of claim 1, wherein the inlet plenum is a radial inlet plenum.

* * * * *